United States Patent [19]

Harada et al.

[11] 4,127,086

[45] Nov. 28, 1978

[54] FUEL INJECTION CONTROL SYSTEM

[75] Inventors: Susumu Harada, Oobu; Kunio Endo, Anzyo, both of Japan

[73] Assignee: Nippondenso Co., Ltd., Kariya, Japan

[21] Appl. No.: 713,833

[22] Filed: Aug. 12, 1976

[30] Foreign Application Priority Data

Aug. 25, 1975 [JP] Japan ..... 50-102782

[51] Int. Cl.[2] ..... F02B 3/00

[52] U.S. Cl. ..... 123/32 EL; 123/32 EJ

[58] Field of Search ..... 123/32 EA, 32 EH, 32 EL, 123/32 EJ

[56] References Cited

U.S. PATENT DOCUMENTS

| | | | |
|---|---|---|---|
| 3,673,989 | 7/1972 | Aono et al. | 123/32 EA |
| 3,759,231 | 9/1973 | Endo | 123/32 EH |
| 3,837,321 | 9/1974 | Sauer | 123/32 EJ |
| 3,858,561 | 1/1975 | Aono | 123/32 EA |
| 3,946,704 | 3/1976 | Monpetit | 123/32 EA |

*Primary Examiner*—Charles J. Myhre
*Assistant Examiner*—Tony M. Argenbright
*Attorney, Agent, or Firm*—Edwin E. Greigg

[57] ABSTRACT

A fuel injection system in which the valve control pulses are generated on the basis of information regarding the engine rpm and the combustion air flow rate and in which the air flow rate is measured by a baffle plate and a position sensor. When the throttle is abruptly closed, the inertia of the air and of the baffle plate prevents a precise measurement and an overly lean fuel mixture may be admitted. Accordingly, the apparatus of the invention is sensitive to the rate of change of the signal from the baffle plate sensor and when that rate is too great, additional current is fed to a multiplying circuit, thereby extending the control pulse length and increasing the amount of fuel fed to the engine.

5 Claims, 5 Drawing Figures

FUEL INJECTION CONTROL SYSTEM

BACKGROUND OF THE INVENTION

The invention relates to a fuel injection system for an internal combustion engine in which fuel is metered out on the basis of the instantaneous engine rpm and the air flow rate. The control information is fed to electromagnetic injection valves in the form of signals whose duration determines the quality of injected fuel. In a known system of this type which will now be described with the aid of FIGS. 1 and 2, the air flow rate is measured by a mechanism 2 which receives air after filtering by a filter 1 in a location 5 within the induction tube of the engine. A baffle plate 5 assumes a relative position which depends on the amount of aspirated air and the air flow meter 2 generates appropriate electrical signals for processing by a subsequent circuuit to be described. Under conditions when the throttle valve 4 is abruptly closed or nearly closed, the inertia of the air then flowing through the baffle plate region causes a certain amount of the air to flow into the region A ahead of the now closed throttle valve. Accordingly, the pressure in region A rises, which causes a force to be exerted on the baffle plate 5 in the direction of the arrow B and thus to change its position in a manner which would normally signal a smaller air flow rate. In other words, for a certain amount of time, the device produces a sensor signal which is different from that corresponding to the actually aspirated air quantity. Only after a certain delay does the air flow rate meter return to its normal state. The events just described cause the air number, i.e., the ratio of air to fuel, of the mixture supplied to the engine to be shifted toward higher values, i.e., the mixture becomes leaner and may cause misfires or near misfires. This is especially awkward in an engine which already operates at relatively high air numbers. Thus, the condition described causes the engine torque to fall and only after a certain time delay at which the output signal from the air flow rate meter 2 returns to normal does the torque increase again. A vehicle which uses an engine supplied in this manner tends to jerk and hesitate and produces an unpleasant driving sensation for the operator.

When misfires actually occur, the exhaust gases assume undesirable characteristics, and the concentration of toxic components, which may be detrimental to catalyzers, etc., increases.

The curves in FIG. 2 illustrate the change of the air flow rate aspirated by the engine due to the vacuum in the induction tube as a function of the motion of the throttle valve 4 and also show the change of the output signal from the air flow rate meter 2.

When the throttle valve 4 is rapidly closed at time $t_o$, the air flow rate does not immediately change, as shown in the middle curve, because the air volume in the intermediate region from the throttle valve 4 up to the inlet valves of the engine is relatively large. If the output signal from the air sensor 2 were to be that shown by the thin line, i.e., corresponding to the air flow rate change in the middle curve, the fuel injection system would receive adequate information. However, due to the above-mentioned reasons, the output signal from the air flow meter 2 is in fact equal to that illustrated in the lower full curve which implies that in the shaded region the fuel air mixture is shifted towards higher air numbers and thus is leaner than desired.

The air flow meter 2 is so embodied that the baffle plate 5 adjusts its angle, depending on the pressure exerted on it, in such a manner that, when the air flow rate increases, the opening angle increases and the output potential delivered by the air flow sensor 2 increases relative to a predetermined norm. In similar manner, the output voltage decreases when the air flow rate decreases.

OBJECT AND SUMMARY OF THE INVENTION

It is a principal object of the invention to provide a fuel injection system which permits a quiet and smooth running of the engine when the air flow rate temporarily changes in a manner which would cause an air flow rate sensor to produce incorrect indications. The fuel injection system according to the invention includes a sensor system located in the induction tube of the engine and a baffle plate for responding to the air flow rate and for producing an electrical signal. This signal is fed to the processor of the fuel injection system and is also delivered to a comparator circuit which senses when this signal changes more rapidly than normal, at which time it generates a supplementary switching function which also engages the fuel injection system. The supplementary switching function causes a compensation for any miscalculation of the length of the fuel injection pulses which may be due to abrupt change of position of the throttle valve. During certain operational engine conditions, if the signal representing the aspirated air flow changes towards lower values sufficiently rapidly, then the fuel supply is increased for a predetermined amount of time and to a predetermined degree. The invention is particularly applicable to a system in which the air flow meter is located between an air filter and a throttle valve, for, in that case, a rapid closing of the throttle valve causes an accumulation of gases and an indication of a substantially smaller air quantity than is actually being aspirated. This object is attained according to the invention by providing that changes in the output signal from the air flow meter which occur more rapidly than a predetermined rate are detected. From the time when these changes exceed a predetermined value, the fuel supply is increased, so that an overall constant fuel-air ratio may be maintained and misfires and the other disadvantages of lean operation can be avoided.

The invention will be better understood as well as further objects and advantages thereof become more apparent from the ensuing detailed description of a preferred embodiment taken in conjunction with the drawings.

DESCRIPTION OF THE PREFERRED EMBODIMENT

Figure 1:
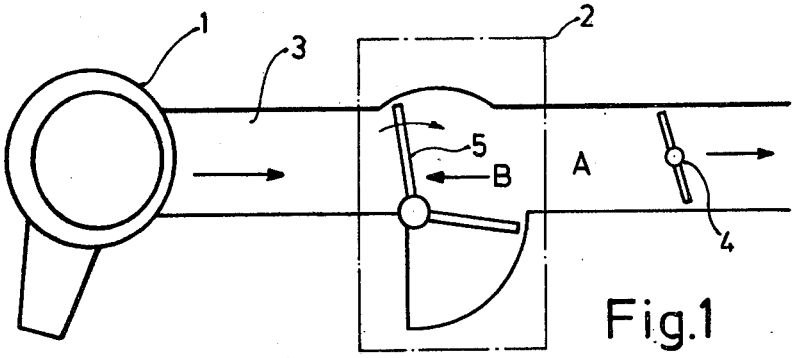
FIG. 1 is a schematic diagram of an air flow rate meter located in the induction tube of an engine.
Figure 2:
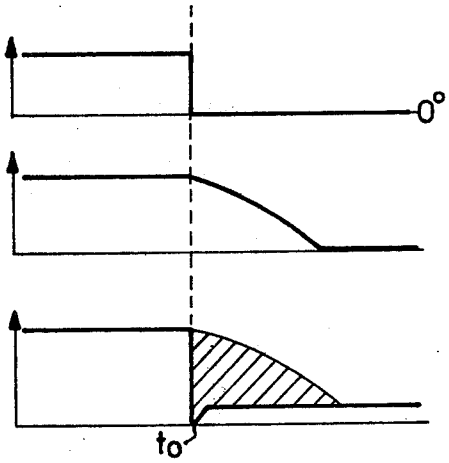
FIG. 2 is a set of curves showing the position of the throttle valve, the air flow rate through the induction tube and the output signal from the air sensor, respectively, in an apparatus belonging to the prior art.
Figure 3:
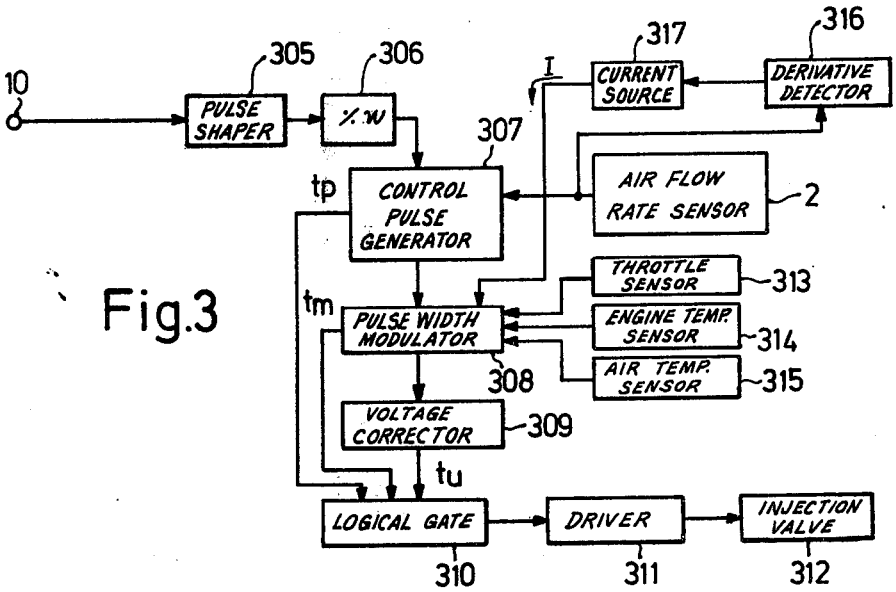
FIG. 3 is a block diagram of an exemplary embodiment of the invention.

Turning now to FIG. 3, there is shown a block diagram of the basic features of the invention wherein rpm signals, for example generated at the primary winding of the ignition coil, are fed to an input contact 10 and are treated by a subsequent pulse former circuit 305. If the engine in question is a six-cylinder engine in which there occurs one injection event per crankshaft revolution by means of injection valves 312, then a frequency divider circuit 306 divides the input pulse sequence in the ration 1:3 since a six-cylinder engine receives three ignition pulses per crankshaft revolution.

Following the frequency divider circuit is a calculating circuit which receives rpm information and the output signal from the air sensor 2 and which generates fuel injection control pulses with a width $t_p$ which is proportional to the ratio of air flow rate to rpm. The calculator or computer circuit 307 may be simply a monostable multivibrator, also referred to subsequently as a control multivibrator. Following the control multivibrator 307 is a multiplier circuit 308 (proportional pulse width modulator) which further influences the control pulses by signals related to various engine conditions, for example the engine temperature sensed by a cooling water sensor 314, an air temperature signal which may derive from a sensor 315, as well as a throttle valve opening signal generated by a sensor circuit 313 which transduces the opening of the throttle valve. When the preliminary pulse of duration $t_p$ has been treated in the multiplier circuit 308, the result is a corrected output signal with a pulse width $t_m$. The multiplication proceeds in known manner and, during stable operation, i.e., when the engine cooling water temperature is at least 70° C and the aspirated air is 20° C while the engine operates in partial load conditions, there is generated an additional current $I_2$ which is added to the current flowing into the multiplier circuit 308. Thus the fuel quantity fed to the engine is increased according to the formula:increased fuel divided by normal fuel = $(I_1 + I_2/I_1)$.

When the pulse of width $t_m$ terminates, a subsequent voltage correcting circuit 309 generates a supplementary pulse of width $t_u$ which takes account of any possible supply voltage fluctuations and thus compensates for a change of the fuel quantity injected by the electromagnetic valves 312 based on such fluctuations. The pulses having the widths $t_p$,$t_m$ and $t_u$ are conjoined by a logical summing curcuit which may be an OR gate 310 so as to produce a total pulse T of width $t_p+t_m+t_u$ and these pulses are fed to an output circuit 311 for final control of the electromagnetic injection valves 312.

An important characteristic of the present invention is a circuit 316 which senses when the rate of change of the output signal from the air sensor 2 is greater than a given amount. If that is the case, a subsequent circuit 317, which may be called an excess fuel circuit, causes an appropriate change of the control signals which finally result in an increased fuel quantity in a constant ratio and during a constant time.

Figure 4:
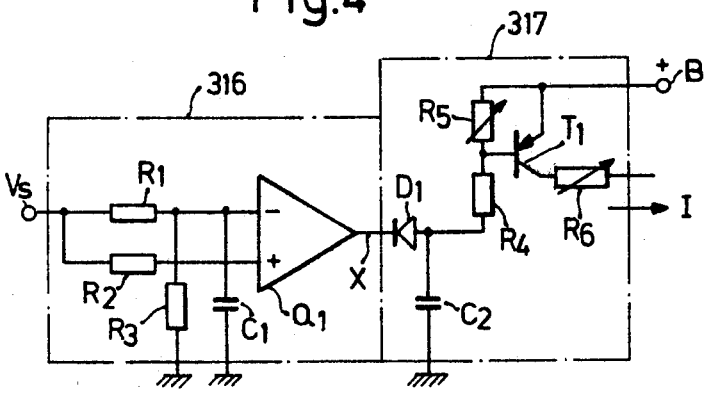
FIG. 4 is a detailed circuit diagram of the main elements of the apparatus according to the invention.

FIG. 4 is a circuit diagram of the circuit 316 for sensing the rate of change of the output signal from the air sensor 2 as well as of a circuit 317 for increasing the fuel quantity. The output signal from the air sensor 2 is designated $V_s$ and it flows through resistors R1 and R2 to both the inverting and non-inverting inputs of a comparator circuit Q1. In the exemplary embodiment illustrated, R1 = R2. The inverting input of the comparator Q1 is grounded through a resistor R3 whose value is preferably such as to be equal to R1 and R2. Thus, the output of the comparator Q1 delivers a voltage which is substantially equal to the usual supply or battery voltage $U_B$. Parallel to the resistor R3, a capacitor C1 is connected from the inverting input of the comparator Q1 to ground so as to provide a delay factor into the processing of the input signals.

Figure 5:
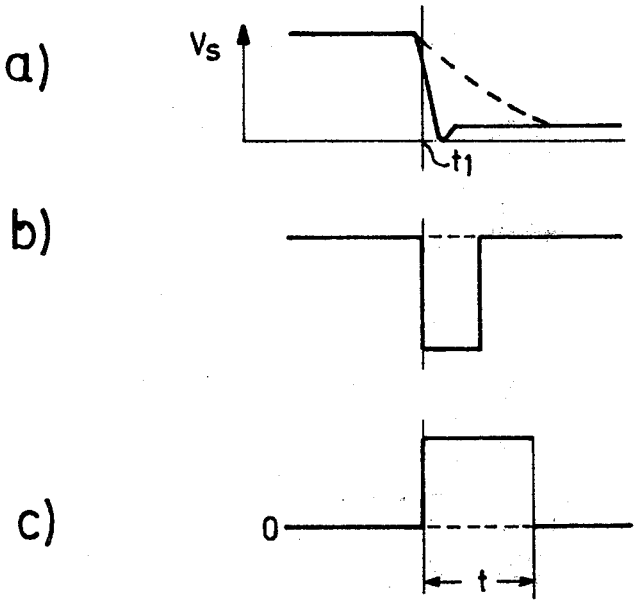
FIG. 5 is a set of curves showing the sensor voltage and the fuel control pulses in a system according to the invention.

If now the signal $V_s$ changes abruptly, as indicated in FIG. 5*a* by the solid line, the signal at the inverting input of the comparator Q1 is delayed by a certain amount by the action of the RC element consisting of R1 and C1, whereas the signal fed to the non-inverting input is not delayed, so that, at a certain time which is indicated in FIG. 5 by the designation $t_1$, the potential at the inverting input is smaller than at the non-inverting input. At this instant, the output of the comparator Q1 assumes a near ground potential as shown in curve 5*b*. Accordingly, a base current may flow through the diode D1 and the resistor R4 into the base of transistor T1, causing it to conduct. The collector circuit of the transistor T1 then carries a current I whose value is adjustable by an adjustable resistor R6 and this current I is fed to the remainder of the circuit (in the exemplary embodiment of FIG. 3 to the multiplier circuit 308) so as to cause an increase of the pulse length $t_m$ and thus an increase of the fuel quantity fed to the engine. As already mentioned, the fuel quantity is increased by the ratio of $(I_1 + I_2/I_1)$.

The current flowing through the resistors R4 and R5 charges a capacitor C2 connected to the anode of the diode D1 so that, at a certain time, the base potential of the transistor T1 rises, for example to the value −0.6 volts, and the transistor T1 blocks again. Thus, the time during which there is a supplementary fuel supply is limited to the time of conduction of the transistor T1. As may be seen, this time can be determined or altered by appropriate dimensioning of the resistors R4 and R5 and the capacitor C2 and preferably by the use of an adjustable resistor R5. The time constant of the delay circuit R1, C1 in the input circuit of the comparator Q1 is so chosen that the output time constant of the comparator Q1 is uninfluenced but if the output voltage of the air flow rate meter 2 changes sufficiently slowly, the voltage inversion at the output of the comparator Q1 does not occur.

If the input signals $V_s$ change very slowly, the potentials at the input of the comparator Q1 are not exchanged (the input voltage at the inverting input of the comparator Q1 is only about half as great as the voltage at the non-inverting input due to the action of the voltage divider circuit R1, R3 and thus the fuel quantity is not increased). A slow signal change is indicated in FIG. 5*a* by the dashed line.

In an actual experimental prototype, it has been found that favorable values for the components are: R1 = R2 = 100 Ohms, C1 = 0.33 microfarad. However the resistor R3 may also be substantially larger, for example 1 megohm, for with no voltage changes, the voltage at the inverting input of the comparator is less than that at the non-inverting input. The time constant which determines the time of conduction of the transistor T1 is so adjusted that the supplementary fuel supply takes place during a time of approximately 200 milliseconds and the current I flowing out of the transistor T1 is so chosen that the supplementary fuel supply is in the ratio 1.15:1 with respect to the normal fuel supply, for example.

By the use of a circuit such as just described, the disadvantages of previously known fuel control circuits are avoided and the error which is due to the accumulation of gases ahead of a rapidly closed throttle valve 4 is eliminated.

In summary, when the engine conditions are such that the output signal from the air sensor indicates a substantial reduction of the air quantity and a certain rate of change exceeding a limit, the fuel supply is increased during a constant period and in a constant ratio. Thus, when the throttle valve is abruptly closed or nearly closed, so that the air flow rate aspirated by the engine can no longer be measured precisely, the engine is supplied with supplementary fuel in a manner to prevent misfires and to improve the comfort of the driver while avoiding the production of toxic exhaust constituents.

The forgoing relates to a preferred exemplary embodiment of the invention, it being understood that numerous variants thereof are possible within the spirit and scope of the invention, the latter being defined by the appended claims.

What is claimed is:

1. In a fuel injection system for internal combustion engines, said system including electromagnetic injection valves, pulse generator means for generating valve control pulses and means for transducing engine rpm and air flow rate into electrical signals fed to said pulse generator means, the improvement comprising:

said means for transducing air flow rate includes a baffle plate located in the induction tube of the engine, and an electrical transducer associated with said baffle plate for generating a voltage related to the position of said baffle plate;

derivative detector means connected to receive said voltage from said air flow rate transducer means, for generating a correcting current whose magnitude varies directly with a negative rate of change of said air flow rate but is unaffected by a positive rate of change of said air flow rate; and a pulse width modulator circuit for extending the duration of said control pulses in proportion to said correcting current; whereby the supply of fuel to the engine is increased temporarily during decreases in the air flow rate.

2. A fuel injection system as defined by claim 1, wherein said derivative detector means includes a comparator with an inverting and a non-inverting input, said output voltage from said baffle plate transducer being fed to said inverting and said non-inverting input, one of said inputs being provided with a bias voltage, and capacitor means connected to said input provided with a bias voltage; whereby, when the input signal changes rapidly toward values corresponding to decreased air flow rate, the output of said comparator changes polarity.

3. A fuel injection system as defined in claim 2, wherein the input resistors of said inverting and non-inverting inputs of said comparator are equal and wherein said inverting input is connected to ground through the parallel connection of a resistor and a capacitor; whereby the time constant defined by said resistor and said capacitor in parallel defines the rate of change of said input signal for which said comparator changes output polarity.

4. A fuel injection system as defined by claim 3, further including control circuit means for receiving the output from said comparator and including a transistor whose base circuit includes timing elements.

5. A fuel injection system as defined by claim 4, wherein said timing elements are two resistors and a capacitor all connected in series between respective supply voltages of said circuit; whereby the dimension of said elements defines the extension of said valve control pulse and the amount of excess fuel fed to the engine.

* * * * *